United States Patent [19]

Becker et al.

[11] 4,349,229

[45] Sep. 14, 1982

[54] LONGWALL MINERAL MINING INSTALLATION

[75] Inventors: Kunibert Becker, Werl; Herbert Beyer, Wern, both of Fed. Rep. of Germany

[73] Assignee: Gewerkschaft Eisenhutte Westfalia, Lunen, Fed. Rep. of Germany

[21] Appl. No.: 229,026

[22] Filed: Jan. 27, 1981

[51] Int. Cl.[3] ..... E21C 27/34

[52] U.S. Cl. ..... 299/32; 299/34; 299/43

[58] Field of Search ..... 299/34, 43, 32

[56] References Cited

U.S. PATENT DOCUMENTS

| | | | |
|---|---|---|---|
| 3,033,542 | 5/1962 | Rosler | 299/34 |
| 4,154,479 | 5/1979 | Braun et al. | 299/43 X |
| 4,248,482 | 2/1981 | Truszczinski | 299/43 X |
| 4,279,445 | 7/1981 | Hauschopp | 299/43 X |
| 4,300,673 | 11/1981 | Von Viebahn et al. | 299/43 X |

FOREIGN PATENT DOCUMENTS

| | | | |
|---|---|---|---|
| 1284382 | 12/1968 | Fed. Rep. of Germany | 299/43 |

*Primary Examiner*—Ernest R. Purser

*Attorney, Agent, or Firm*—Sughrue, Mion, Zinn, Macpeak and Seas

[57] ABSTRACT

A longwall mineral mining installation comprises a scraper-chain conveyor having a scraper assembly, a first straight conveyor portion extending along the longwall working, a second straight conveyor portion extending along a roadway positioned at one end of the longwall working, and a curved conveyor section connecting the two straight conveyor portions. A guide assembly is provided for guiding the scraper assembly around the curved conveyor section. A guide is fixed to the face side of the first straight conveyor portion, and a winning machine is reciprocable along the guide. A drive station is mounted on the goaf side of the first straight conveyor portion in the region of the curved conveyor section. A drive sprocket is rotatably mounted on the face side of the first straight conveyor portion in said region. The drive sprocket drives the winning machine via a drive chain. A drive shaft drivably connects the drive station and the drive sprocket. The drive station includes a drive motor whose axis of rotation is substantially parallel to the longitudinal axis of the first straight conveyor portion, and the guide is angled away from the first straight conveyor portion in said region.

14 Claims, 2 Drawing Figures

LONGWALL MINERAL MINING INSTALLATION

BACKGROUND TO THE INVENTION

This invention relates to a mineral mining installation, and in particular to a mineral mining installation for winning material along the entire length of a longwall working.

Longwall workings are usually won by a winning machine (such as a plough) which is movable to and fro along a guide fixed to the face side of a scraper-chain conveyor. The conveyor usually extends practically the entire length of the longwall face, and has bulky drive stations (for both the conveyor and the winning machine) at its ends. These drive stations inevitably occupy a large amount of space at the ends of the working, and effectively prevent the winning machine from winning material in the end (stable-hole) regions of the longwall face. These stable-hole regions must, therefore, be won separately; and this can be done either manually, or by the use of auxiliary (stable-hole) winning machines. Both of these courses are undesirable, as they require extra effort and/or equipment. Moreover, because of the congestion in these regions (which arises from the positioning of the bulky drive stations), there are difficulties in the actual winning of material in the stable-hole regions.

One way of getting round these difficulties is to have a longwall conveyor which has curved conveyor sections at each end, the curved conveyor sections leading to conveyor portions situated in the roadways at the two ends of the longwall working. In this case, the guide at the face side of the conveyor can extend the entire length of the longwall face, so that a single winning machine can win material even in the stable-hole regions. Moreover, the drive stations for the conveyor can be positioned in the roadways, so that congestion of the ends of the longwall working is reduced. The scraper assembly of such a conveyor is guided round each of the curved conveyor sections by a respective guide assembly constituted by a pair of pulley wheels which are independently rotatably mounted on a vertical axle radially inward of the respective curved conveyor section. One pulley wheel guides the scraper assembly in the upper (conveying) run, and the other pulley wheel guides the scraper assembly in the lower (return) run. Usually, the pulley wheels guide the scraper assembly by engagement with the radially-inner ends of the scrapers.

Although this arrangement does reduce the congestion at the ends of the longwall working, whilst permitting the entire longwall face to be won by a single winning machine, there is still a certain amount of congestion in the stable-hole regions. This arises because the drive stations for the winning machine extend, at least partially, across the longwall working. Although this may not be too much of a problem for normal longwall working, it is extremely disadvantageous for so-called retreating longwall working (that is to say where the two roadways are driven their entire length to the far end of a seam, and the seam is then won in strips, back along the roadways). This is because the roof of the mine in the regions where the longwall working merges with the roadways need to be adequately supported, and roof support units of the type which support the rest of the longwall working cannot fulfil this function because they are too large to fit in the restricted areas at the ends of the working.

The aim of the invention is to provide a longwall mineral mining installation that is capable of winning the entire longwall face using a single winning machine, and which can be used for both retreating and normal working.

SUMMARY OF THE INVENTION

The present invention provides a longwall mineral mining installation comprising a scraper-chain conveyor having a scraper assembly, a first straight conveyor portion extending along the longwall working, a second straight conveyor portion extending along a roadway positioned at one end of the longwall working, and a curved conveyor section connecting the two straight conveyor portions, a guide assembly for guiding the scraper assembly around the curved conveyor section, a guide fixed to the face side of the first straight conveyor portion, a winning machine reciprocable along the guide, a drive station mounted on the goaf side of the first straight conveyor portion in the region of the curved conveyor section, a drive sprocket rotatably mounted on the face side of the first straight conveyor portion in said region, the drive sprocket driving the winning machine via a drive chain, and a drive shaft drivably connecting the drive station and the drive sprocket, wherein the drive station includes a drive motor whose axis of rotation is substantially parallel to the longitudinal axis of the first straight conveyor portion, and the guide is angled away from the first straight conveyor portion in said region.

This installation permits a longwall face to be won, along its entire length, by a single winning machine. At the same time, the arrangement of the guide assembly and drive station leave plenty of room for positioning roof support units in their vicinity.

Advantageously, the drive motor of the drive station drivably engages the drive shaft via a mitre gearing, and preferably the drive motor is an electric motor.

Conveniently, the guide assembly comprises a pair of co-axial, independently rotatable, vertically-spaced rollers. This is advantageous in that such an assembly has a relatively small height, so that any large pieces of rock carried by the conveyor do not foul the roof of the mine working as they go round the curved conveyor section. Preferably, means (such as hydraulic ram means) are provided for adjusting the height and angle of the guide assembly.

Advantageously, the installation further comprises an auxiliary conveyor which leads from said region to the second straight conveyor portion. Preferably, the auxiliary conveyor is spaced from the guide in said region by a distance which is large enough to permit the winning machine to pass therebetween. The auxiliary conveyor can be used for removing small pieces of won material (for example fine coal) from the end of the face.

The installation may further comprise a plurality of roof support units positioned side-by-side along the longwall working on the goaf side of the first straight conveyor portion, and additional roof support units positioned side-by-side in said region and in the adjacent roadway. In order to accommodate the drive station, the additional roof support units are offset towards the goaf side of the working with respect to the other roof support units.

Advantageously, each of the additional roof support units is attached to the conveyor by means of a respective floor plate, at least one of the floor plates passing beneath the drive station.

Preferably, the drive shaft passes through a box-shaped aperture in the conveyor.

BRIEF DESCRIPTION OF THE DRAWINGS

A mineral mining installation constructed in accordance with the invention will now be described, by way of example, with reference to the accompanying drawings, in which.

DESCRIPTION OF PREFERRED EMBODIMENT

Figure 1:
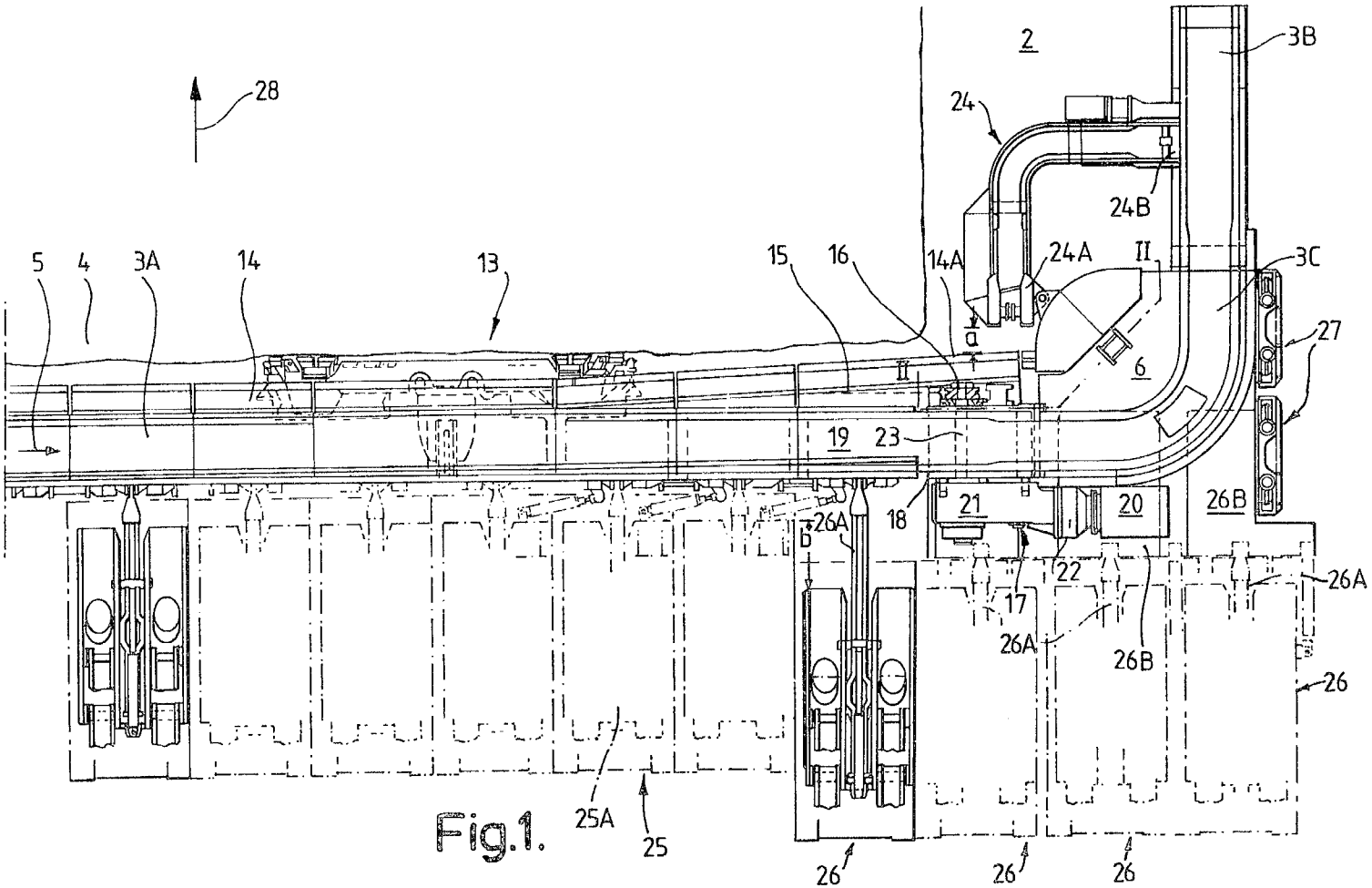
FIG. 1 is a plan view of one end portion of the mineral mining installation.

Referring to the drawings, FIG. 1 shows a mineral mining installation which is positioned partially within a longwall working 1, and partially within a pair of roadways 2 (only one of which can been seen). The installation includes a scraper-chain conveyor 3, the illustrated part of which has a first straight portion 3A joined, at one end, to a second straight portion 3B by means of a curved conveyor section 3C. The first straight conveyor portion 3A extends alongside the face 4 of the longwall working 1, and the second straight conveyor portion 3B extends along the roadway 2. The conveyor 3 also has a third straight conveyor portion (not shown) at the other end of the first straight conveyor portion 3A, the third straight conveyor portion extending along the other roadway 2, and being connected to the first straight conveyor portion by means of a curved conveyor section (not shown). The scraper-chain conveyor 3 is made from individual channel sections, which are joined together end-to-end so as to permit limited articulation therebetween. The scraper assembly (not shown) is driven along the upper, conveying run of the conveyor 3 in the direction of the arrow 5.

Figure 2:
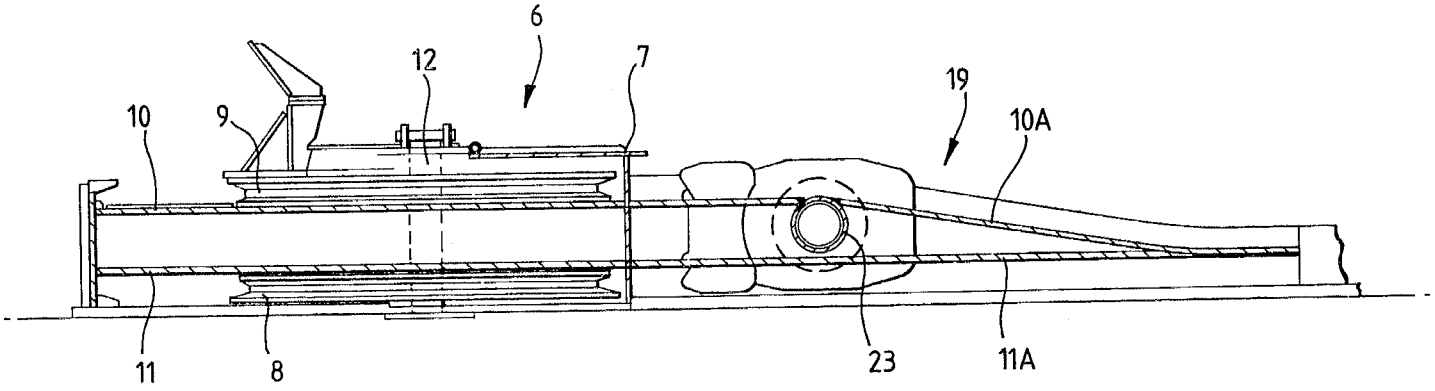
FIG. 2 is a cross-section taken on the line II—II of FIG. 1.

The curved conveyor section 3C is positioned in the roadway 2 at the end of the longwall working 1, and a guide assembly 6 is provided at the inner side of the curved conveyor section. The guide assembly 6 is fixed to the curved conveyor section 3C to form a single component. As best seen in FIG. 2, the guide assembly 6 has a housing 7 containing a lower pulley wheel 8 and an upper pulley wheel 9. The pulley wheels 8 and 9 are separated by upper and lower floor plates 10 and 11 respectively, and are independently rotatable about a vertical axle 12. The upper pulley wheel 9 guides the inner edges of the scrapers (not shown) of the scraper assembly round the curved conveyor section 3C in the upper (conveying) run, and the lower pulley wheel 8 guides the inner edges of the scrapers in the lower (return) run. The circumferential edges of the pulley wheels 8 and 9 are formed with annular grooves shaped to mate with the inner edges of the scrapers, and each of the pulleys has a radius corresponding to that of the inside curve of the curved conveyor section 3C. A drive station (not shown) for the scraper chain of the scraper assembly is provided at that end of the conveyor portion 3B remote from the curved conveyor section 3C. A similar drive station is provided at the free end of the third straight conveyor portion.

A plough 13, for winning mineral material (such as coal) from the face 4, is guided on a ramp-like guide 14 fixed to the face side of the conveyor portion 3A. The guide 14 is constituted by a plurality of guide sections joined end-to-end, and defines two enclosed channels (not shown) for the upper and lower runs of a plough drive chain 15. The plough drive chain 15 is driven, via a sprocket wheel 16, by means of a plough drive station 17, which is flanged, at 18, to the end channel section 19 of the conveyor portion 3B. This end channel section 19 is a special channel section known as a connection channel section. The plough drive station 17 has an electric motor 20 and a gearbox 21. The axis 22 of the electric motor 20 is parallel to the axis of the first straight conveyor portion 3A. The gearbox 21 includes a mitre gearing (not shown) for transferring the drive output of the gearbox to a drive shaft 23 which passes through the conveyor section 19 and drives the sprocket wheel 16. As seen in FIG. 2, the floors 10 and 11 of the guide assembly 6 are contiguous with floors 10A and 11A of the channel section 19. The end portion 14A of the guide 14 is angled slightly away from the end of the conveyor portion 3A, so as to avoid the sprocket wheel 16.

A fine-coal conveyor 24 is positioned in the roadway 2 adjacent to the guide assembly 6. The loading end 24A of the conveyor 24 is positioned a short distance a from the end of the guide portion 14A; and the delivery end 24B of the conveyor 24 is arranged to deliver fine coal to the second straight conveyor portion 3B. The fine-coal conveyor 24 is used to remove the fine coal deposited at the end of the longwall working 1. The distance a is chosen to be large enough to permit the plough 13 to pass between the guide portion 14A and the loading end 24A of the fine-coal conveyor.

The roof of the longwall working 1 is supported by a plurality of roof support units 25, positioned side-by-side along the goaf side of the conveyor portion 3A. The roof of the mine in the region where the longwall working 1 merges with the roadway 2, is supported by a number of similar roof support units 26. Each of the roof support units 25 has an advance mechanism 25A attached to the first straight conveyor portion 3A. The advance mechanisms 25A serve to advance the conveyor portion 3A to follow up the advance of the face 4, and to advance these roof support units themselves in a follow-up sequence. Similarly, each of the roof support units 26 has an advance mechanism 26A. The advance mechanisms 26A associated with the curved conveyor section 3C are connected thereto by means of respective floor plates 26B which pass underneath the plough drive station 17. The advance mechanism associated with the channel section 19 is connected directly thereto. In order to avoid the plough drive station 17, the roof support units 26 are off-set, with respect to the roof support units 25, towards the goaf of the longwall working 1 by a distance b. This distance b is a relatively small distance, and is hardly disadvantageous, particularly as most of the roof support units 26 are positioned in the roadway 2, where there is more room, and where their supporting function is assisted by the usual roadway supports (not shown).

Hydraulic hoists 27 are provided for controlling the height and position of the guide assembly 6.

As will be apparent from FIG. 1, the illustrated installation is being used in a "retreating" longwall working system, in which the direction 28 of face advance is the same as that in which won material is moved along the second straight conveyor portion 3B. The installation of the invention is particularly useful for a "retreating" longwall working system because the plough drive station 17 (which extends parallel to the longwall working 1 instead of at right-angles thereto) occupies less room that hitherto, and so permits standard roof support units to be used in the regions where the longwall working 1 mergew with the roadway 2, whilst movement of the plough 13 along the entire length of the face 4 is unhindered. However, the installation could also be used for normal longwall working systems. In either case, the arrangement of the curved conveyor section 3C and its guide assembly 6 is advantageous, in that it permits large rocks to be conveyed away from the face 4 and down the roadway 2. This is because such an arrangement has a relatively small height, so that large rocks can be conveyed without fouling the roof of the working.

As the second straight conveyor portion 3B is used to convey won mineral material away from the longwall working 1 and towards the mine shaft, it needs to extend a reasonably long way along the roadway 2. However, as the third straight conveyor portion has no such conveying functions, it need only be long enough to provide support for a conveyor drive station.

We claim:

1. A longwall mineral mining installation comprising a scraper-chain conveyor having a scraper assembly, a first straight conveyor portion extending along the longwall working, a second straight conveyor portion extending along a roadway positioned at one end of the longwall working, and a curved conveyor section connecting the two straight conveyor portions, a guide assembly for guiding the scraper assembly around the curved conveyor section, a guide fixed to the face side of the first straight conveyor portion, a winning machine reciprocable along the guide, a drive station mounted on the goaf side of the first straight conveyor portion in the region of the curved conveyor section, a drive sprocket rotatably mounted on the face side of the first straight conveyor portion in said region, the drive sprocket driving the winning machine via a drive chain, and a drive shaft drivably connecting the drive station and the drive sprocket, wherein the drive station includes a drive motor whose axis of rotation is substantially parallel to the longitudinal axis of the first straight conveyor portion, and the guide is angled away from the first straight conveyor portion in said region.

2. A mineral mining installation according to claim 1, wherein the drive motor of the drive station drivably engages the drive shaft via a mitre gearing.

3. A mineral mining installation according to claim 1, wherein the drive motor is an electric motor.

4. A mineral mining installation according to claim 1, wherein the guide assembly comprises a pair of co-axial, independently rotatable, vertically-spaced rollers.

5. A mineral mining installation according to claim 1, further comprising means for adjusting the height and angle of the guide assembly.

6. A mineral mining installation according to claim 5, wherein said height and angle adjusting means comprise hydraulic ram means.

7. A mineral mining installation according to claim 1, further comprising an auxiliary conveyor which leads from said region to the second straight conveyor portion.

8. A mineral mining installation according to claim 7, wherein the auxiliary conveyor is spaced from the guide in said region by a distance which is large enough to permit the winning machine to pass therebetween.

9. A mineral mining installation according to claim 1, further comprising a plurality of roof support units positioned side-by-side along the longwall working on the goaf side of the first straight conveyor portion.

10. A mineral mining installation according to claim 9, further comprising additional roof support units positioned side-by-side in said region and in the adjacent roadway.

11. A mineral mining installation according to claim 10, wherein the additional roof support units are offset towards the goaf side of the working with respect to the other roof support units.

12. A mineral mining installation according to claim 10, wherein each of the additional roof support units is attached to the conveyor by means of a respective floor plate.

13. A mineral mining installation according to claim 12, wherein at least one of said floor plates passes beneath the drive station.

14. A mineral mining installation according to claim 1, wherein the drive shaft passes through a box-shaped aperture in the conveyor.

* * * * *